US007849642B2

(12) United States Patent
Forster et al.

(10) Patent No.: US 7,849,642 B2
(45) Date of Patent: Dec. 14, 2010

(54) TILE WITH WIDE COUPLING CONFIGURATION AND METHOD FOR THE SAME

(75) Inventors: Cheryl Forster, Salt Lake City, UT (US); Mark Jenkins, West Valley City, UT (US); Tyler Laitinen, Sydney (AU)

(73) Assignee: Connor Sport Court International, Inc., Salt Lake City, UT (US)

( * ) Notice: Subject to any disclaimer, the term of this patent is extended or adjusted under 35 U.S.C. 154(b) by 517 days.

(21) Appl. No.: 11/078,940

(22) Filed: Mar. 11, 2005

(65) Prior Publication Data

US 2005/0223666 A1 Oct. 13, 2005

Related U.S. Application Data

(60) Provisional application No. 60/552,952, filed on Mar. 12, 2004.

(51) Int. Cl.
*E04F 11/16* (2006.01)

(52) U.S. Cl. ..... 52/177; 52/591.1; 52/592.2; 52/180; 52/392

(58) Field of Classification Search ..... 52/591.1, 52/592.1, 591.4, 591.5, 392, 591.2, 180, 52/589.1, 586.1, 582.2, 747.11, 591.3, 581, 52/592.2; 428/192; 15/238
See application file for complete search history.

(56) References Cited

U.S. PATENT DOCUMENTS 1,472,956 A 11/1923 Biegler
1,824,571 A 5/1927 Richardson
2,225,828 A 12/1940 Godschall
2,735,166 A 2/1956 Hoseason
3,222,834 A 12/1965 Taft
3,318,476 A 5/1967 Clark
3,350,013 A 10/1967 Bergquist
3,425,624 A 2/1969 Jacobs
3,439,312 A 4/1969 Greasley
3,500,606 A * 3/1970 Wharmby ..... 52/591.1
3,565,276 A 2/1971 O'Brien
3,723,233 A 3/1973 Bourke
3,736,713 A 6/1973 Flachbarth et al.
3,802,144 A 4/1974 Spica
3,820,912 A 6/1974 Hughes
3,836,075 A 9/1974 Botbol
3,844,440 A 10/1974 Hadfield et al.

(Continued)

*Primary Examiner*—Richard E Chilcot, Jr.
*Assistant Examiner*—Chi Nguyen
(74) *Attorney, Agent, or Firm*—Thorpe North & Western LLP

(57) ABSTRACT

A method and apparatus providing a tile configured to form a modular floor covering including an array of substantially identical tiles. The tile includes a top surface, bottom side, front and rear sides and first and second lateral sides. The top surface includes an elongated shape and the bottom side includes a support grid. The front and rear sides are defined along a longitudinal length of the elongated shape. The front side includes at least one first hinge member and the rear side includes at least one complementary second hinge member configured to be engageable with the at least one first hinge member of an adjacently positioned tile. The first and second lateral sides define a width of the elongated shape with the first and second lateral sides including a respective tab and slot coupling portion each having a coupling length at least one-third the width of the elongated shape.

24 Claims, 6 Drawing Sheets

U.S. PATENT DOCUMENTS 3,909,996 A 10/1975 Ettlinger, Jr. et al.
3,911,635 A 10/1975 Traupe
3,937,861 A 2/1976 Zuckerman et al.
3,946,529 A 3/1976 Chevaux
3,955,836 A 5/1976 Traupe
4,008,352 A 2/1977 Dawes et al.
4,008,548 A 2/1977 Leclerc
4,167,599 A 9/1979 Nissinen
4,226,064 A 10/1980 Kraayenhof
4,244,484 A 1/1981 Guritz et al.
4,285,518 A 8/1981 Pearo
4,287,693 A 9/1981 Collette
4,338,758 A 7/1982 Hagbjer
4,361,614 A 11/1982 Moffitt, Jr.
4,386,138 A 5/1983 Arbit
4,419,382 A 12/1983 Sliemers et al.
4,424,968 A 1/1984 Smith
4,436,779 A 3/1984 Menconi et al.
4,468,910 A 9/1984 Morrison
4,478,901 A 10/1984 Dickens et al.
4,497,858 A 2/1985 Dupont et al.
4,541,132 A 9/1985 Long
4,559,250 A 12/1985 Paige
4,584,221 A 4/1986 Kung
4,596,731 A 6/1986 Cudmore et al.
4,650,188 A 3/1987 Schroeder
4,681,482 A 7/1987 Arciszewski et al.
4,749,302 A 6/1988 DeClute
4,766,020 A 8/1988 Ellingson, Jr.
4,807,412 A 2/1989 Frederiksen
4,826,351 A 5/1989 Haberhauer et al.
4,860,510 A 8/1989 Kotler
4,877,672 A 10/1989 Shreiner
4,917,532 A 4/1990 Haberhauer et al.
4,930,286 A 6/1990 Kotler
4,948,116 A 8/1990 Vaux
4,964,751 A 10/1990 Rope et al.
4,973,505 A 11/1990 Bielous
5,157,804 A 10/1992 Williams
5,190,799 A 3/1993 Ellingson, III
5,195,288 A 3/1993 Penczak
5,215,802 A 6/1993 Kaars Sijpesteijn
5,228,253 A 7/1993 Wattelez
5,234,738 A 8/1993 Wolf
5,253,464 A 10/1993 Nilsen
5,323,575 A 6/1994 Yeh
5,333,423 A 8/1994 Propst
5,364,204 A 11/1994 MacLeod
5,379,557 A 1/1995 Kotter
5,387,842 A 2/1995 Roth et al.
5,403,453 A 4/1995 Roth et al.
5,403,637 A 4/1995 Pickard et al.
5,414,324 A 5/1995 Roth et al.
5,456,972 A 10/1995 Roth et al.
5,462,771 A 10/1995 Motoki et al.
5,465,548 A * 11/1995 Niese ..... 52/741.1
5,466,424 A 11/1995 Kusano et al.
5,502,148 A 3/1996 Hentschel et al.
5,509,244 A 4/1996 Bentzon
5,518,799 A 5/1996 Finestone et al.
5,526,619 A 6/1996 Vagedes
5,527,128 A 6/1996 Rope et al.
5,567,490 A 10/1996 Papazian et al.
5,573,715 A 11/1996 Adams et al.
5,628,160 A 5/1997 Kung
5,679,385 A 10/1997 Adams et al.
5,693,390 A 12/1997 Inagaki et al.
5,695,064 A 12/1997 Huang et al.
5,713,806 A 2/1998 Teitgen et al.
5,719,491 A * 2/1998 Kolanko et al. ..... 323/303
5,758,467 A 6/1998 Snear et al.
5,761,867 A 6/1998 Carling
5,787,654 A 8/1998 Drost
5,803,973 A 9/1998 Szczyrbowski et al.
5,819,491 A 10/1998 Davis
5,833,386 A 11/1998 Rosan et al.
5,865,007 A 2/1999 Bowman et al.
5,904,021 A 5/1999 Fisher
5,907,934 A 6/1999 Austin
5,910,401 A 6/1999 Anderson et al.
5,950,378 A 9/1999 Council et al.
5,992,106 A 11/1999 Carling et al.
6,032,428 A 3/2000 Rosan et al.
6,098,354 A 8/2000 Skandis
6,231,939 B1 5/2001 Shaw et al.
6,397,543 B1 * 6/2002 Hamar ..... 52/403.1
6,436,159 B1 8/2002 Safta et al.
6,562,414 B2 5/2003 Carling
D481,138 S 10/2003 Forster et al.
6,684,582 B2 2/2004 Peart et al.
6,751,912 B2 6/2004 Stegner et al.
6,820,386 B2 * 11/2004 Kappeli et al. ..... 52/591.4
6,931,808 B2 * 8/2005 Hamar ..... 52/403.1
2002/0189176 A1 12/2002 Stegner et al.
2003/0093964 A1 * 5/2003 Bushey et al. ..... 52/592.1

* cited by examiner

TILE WITH WIDE COUPLING CONFIGURATION AND METHOD FOR THE SAME

RELATED APPLICATIONS

This application claims priority to U.S. Provisional Application Ser. No. 60/552,952, filed Mar. 12, 2004, which is incorporated by reference herein in its entirety.

FIELD OF THE INVENTION

The present invention relates generally to tiles for a synthetic modular floor covering. More particularly, the present invention relates to a coupling configuration for coupling the tiles to form the modular floor covering.

BACKGROUND OF THE INVENTION AND RELATED ART

Numerous types of flooring have been used to create playing areas for such sports as basketball and tennis, as well as for other purposes. These flooring assemblies include concrete, asphalt, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps. Wood floors, such as are used for many basketball courts, have an appropriate amount of give to avoid such injuries. The wood floors, however, are expensive to install and require continued maintenance to keep them in good condition.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. Nos. Des. 274,588; 3,438,312; 3,909,996; 4,436,799; 4,008,548; 4,167,599; 4,226,064 and 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood.

One problem with synthetic flooring involves the time consuming nature of installation. Typically, each of the tiles will include several couplings on each attachment side of the tiles. The couplings are typically small and require careful alignment and precise positioning to make proper attachment. When installing a large floor covering with hundreds, and even thousands, of tiles, coupling each of the tiles is long and laborious task. The numerous amounts of couplings for each of the tiles often results in the installer miss-attaching some of the couplings due to human error and fatigue. Further, the miss-attached couplings are often not readily identifiable.

In addition, flooring assemblies may be formed by attaching multiple tiles to form several columns, which can be rolled up for easy storage. These columns can then be unrolled in side-by-side proximity and attached to form a tile array. It is often difficult for the installer to identify, properly align and mate the proper corresponding tiles, resulting in offsetting the couplings and tiles between adjacent columns. Further, tiles of one column may become spaced slightly different with respect to the tiles in another column, resulting in different lengths in the columns and miss-alignment of the couplings between the adjacent columns. As a result, proper interconnection of the couplings of the tiles is very time consuming.

Therefore, it would be advantageous to provide a flooring tile that minimizes the laborious task of coupling large amounts of tiles to form a floor covering. It would also be advantageous to provide a flooring tile with couplings that can be readily identified for proper alignment and can be readily attached to simplify the task of forming the floor covering.

SUMMARY OF THE INVENTION

In light of the problems and deficiencies inherent in the prior art, the present invention seeks to overcome these by providing a modular tile having a wide coupling configuration.

In general, the present invention relates to a method and apparatus providing a tile configured to form a modular floor covering including an array of substantially identical tiles. The tile includes a top surface, a bottom side, front and rear sides and first and second lateral sides. The top surface includes an elongated shape and the bottom side includes a support grid. The front and rear sides are defined along a longitudinal length of the elongated shape. The front side includes at least one first hinge member and the rear side includes at least one complementary second hinge member configured to be engageable with the at least one first hinge member of an adjacently positioned tile. The first and second lateral sides define a width of the elongated shape with the first and second lateral sides including a respective tab and slot coupling portion each having a coupling length at least one-third the width of the elongated shape.

More specifically, in accordance with the invention as embodied and broadly described herein, the present invention features a tile configured to form a modular floor covering including an array of substantially identical tiles, the tile comprising: (a) a top surface having an elongated shape and a bottom side including a support grid; (b) front and rear sides defined along a longitudinal length of the elongated shape, the front side including at least one first hinge member and the rear side including at least one complementary second hinge member configured to be engageable with an at least one first hinge member of an adjacently positioned tile; and (c) first and second lateral sides defining a width of the elongated shape, the first and second lateral sides including a respective tab and slot coupling portion each having a coupling length at least one-third the width of the elongated shape.

The present invention also features a modular floor covering, comprising: (a) multiple tiles configured to be removably coupled to form a tile array including columns and rows of the multiple tiles, at least one of the multiple tiles including a top surface having an elongated shape and a bottom side including a support configuration, and front and rear sides defined along a longitudinal length of the elongated shape, the front side including at least one first hinge member and the rear side including at least one second hinge member; and (b) first and second lateral sides defining a width of the elongated shape, the first and second lateral sides including a respective tab and slot coupling portion each having a coupling length at least one-third the width of the elongated shape; (c) wherein the at least one first and second hinge members formed on the respective front and rear sides are each configured to mate with respective complementary second and first hinge members of other tiles positioned adjacent the front and rear sides, respectively; and (d) wherein the tab and slot coupling portion of the respective first and second lateral sides are each configured to rigidly mate with respective slot and tab coupling portions of the tiles positioned adjacent the first and second lateral sides, respectively.

The present invention further features a method of installing a modular flooring onto a floor surface, the method comprising: (a) unrolling multiple tile rolls, each having at least one column of tiles, onto a floor surface with a top surface facing upward and a bottom side having a support grid facing the floor surface, the tiles coupled together along a longitudinal length of front and rear sides of the tiles with at least one combination of first and second hinge members integrally formed in the respective front and rear sides of the tiles; and (b) coupling adjacently positioned columns by interconnecting a tab and slot coupling portion formed in respective first and second lateral sides of each of the tiles to form a tile array of the tiles, wherein each of the tab and slot coupling portions include a coupling length at least one-third a width of each of the tiles.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 5(*a*) illustrates a partial perspective view of the top surface of the tile, depicting the tile having perforations formed through the top surface, according to an embodiment of the present invention;

FIG. 10(*a*) illustrates a cross-sectional view of the complementary hinge couplings facilitating rotation;

FIG. 11(*a*) illustrates a cross-sectional view of the complementary hinge couplings of FIG. 11 facilitating rotation and a tighter tolerance or closer tile fit as a result of the rounded corner of the post attaching portion;

FIG. 13(*a*) illustrates a top view of the two columns of the tiles interconnected to form the tile array.

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 13, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Figure 1:
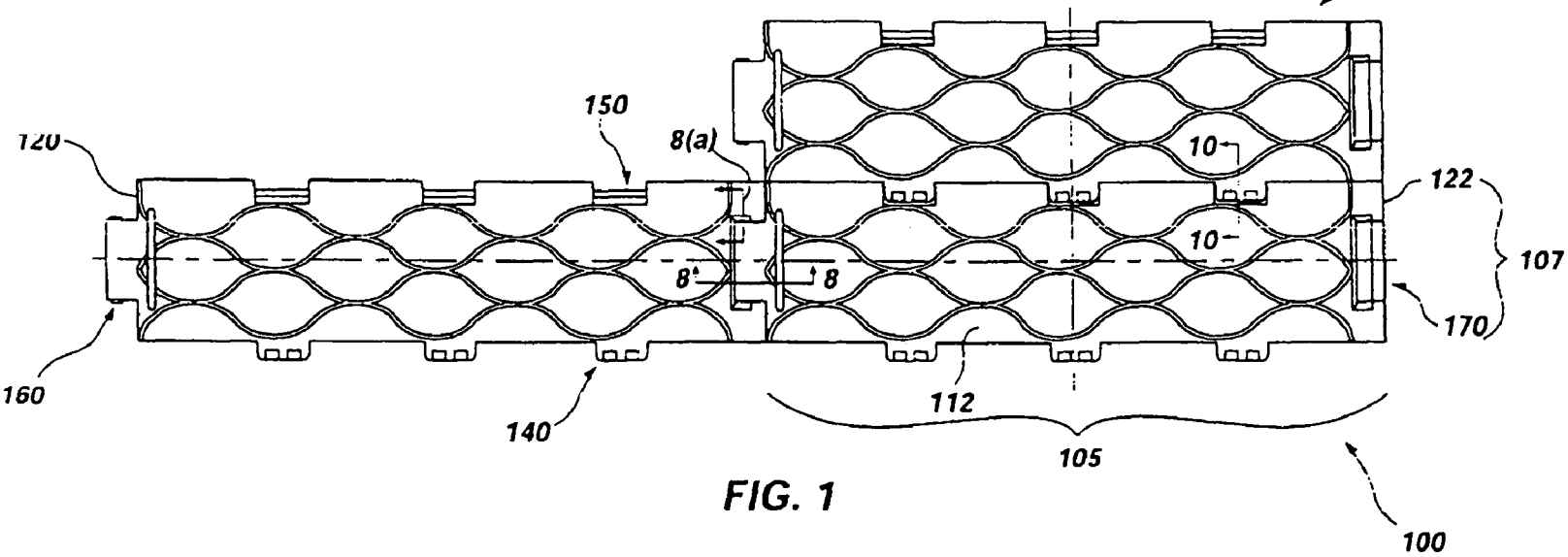
FIG. 1 illustrates a top view of a tile array, depicting a tile interconnected to other tiles at adjacent sides thereof, according to an embodiment of the present invention.
Figure 2:
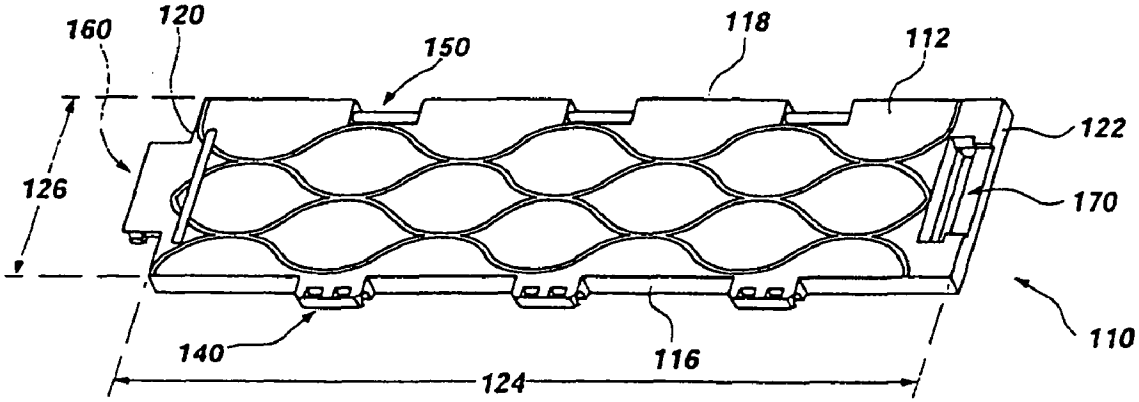
FIG. 2 illustrates a perspective view of the tile, according to an embodiment of the present invention.

FIGS. 1 and 2 illustrate a tile 110 configured to be removably coupled with multiple substantially identical tiles to form a tile array 100. Such a tile array 100 is configured to be modular and provide a synthetic floor covering over a floor surface (not shown). The floor surface can be any suitable floor surface, such as concrete, wood, grass, synthetic grass, soil or the like. The tile 110 can be formed of any suitable synthetic material, such as a polymeric type material, or any other suitable material known by one of ordinary skill in the art.

Such a tile 110 can include a top surface 112 with an opposite bottom side 114 (FIG. 3) or under-side. The top surface 112 can include a periphery with, but is not limited to, a generally elongated rectangular shape defining a longitudinal length 124 and a width 126. The periphery of the tile can define opposite front and rear sides 116 and 118 and opposite first and second lateral sides 120 and 122. The front side 116 and rear side 118 can be defined along the longitudinal length 124 and the first and second lateral sides 120 and 122 can be defined along the width 126 of the elongated rectangular shape.

The front and rear sides 116 and 118 of a tile 110 can each include at least one coupling portion configured to complimentarily couple with the at least one coupling portion of respective rear and front sides of adjacently positioned tiles. The at least one coupling portion can include a hinge configuration, or any suitable configuration for coupling tiles. In particular, the front side 116 of the tile 110 can include at least one first hinge member 140 and the rear side 118 of the tile 110 can include at least one second hinge member 150. The first and second hinge members 140 and 150 are configured to be complementary and engageable with respective second and first hinge members 150 and 140 of other substantially identical tiles 110. As such, tiles 110 can be interconnected between complementary first and second hinge members 140 and 150 into a column 105 of the tiles, depicted in simplified form of two tiles in the column 105.

In addition, the first and second lateral sides 120 and 122 of the tile 110 each include a coupling portion. In particular, the first lateral side 120 can include a tab or first coupling portion 160 and the second lateral side 122 can include a slot or second coupling portion 170. Such first and second coupling portions 160 and 170 can be complementary respective male and female coupling portions, or any other suitable tab/slot coupling configuration. With this arrangement, the first and second coupling portions 160 and 170 at the first and second lateral sides 120 and 122 are configured to couple to complementary coupling portions at the first and second lateral sides 120 and 122 of identical and adjacently positioned tiles 110 to form a row of the tiles 110, depicted in simplified form of two tiles in the row 107. In this manner, the tiles 110 can be interconnected into multiple columns 105 and rows 107 to form the tile array 100.

Figure 3:
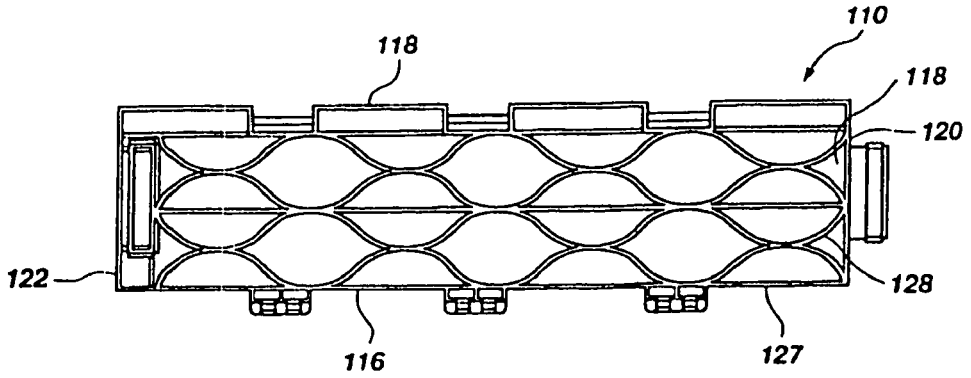
FIG. 3 illustrates a bottom view of the tile.
Figure 4:
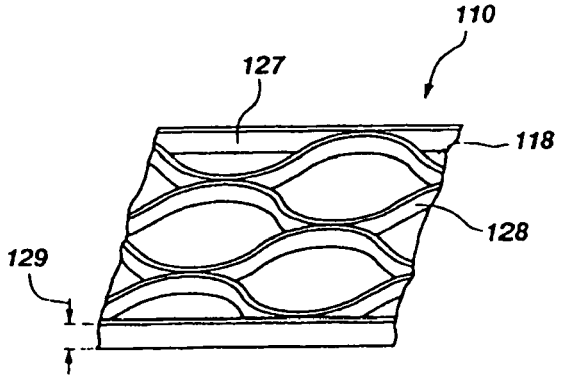
FIG. 4 illustrates a partial perspective view of a bottom side of the tile, depicting the tile having a support grid formed on the bottom side thereof.

Referring now to FIGS. 3 and 4, the bottom side 114 or under-side of the tile 110 can include a support grid 128 configured to support and stabilize the top surface (not shown) of the tile 110. Such a support grid 128 can at least partially include, but is not limited to, a wave configuration, or any other suitable configuration, such as a honeycomb configuration, a web configuration, or the like. The support grid 128 can also include periphery portions 127 outlining the periphery of the tile and/or the wave configuration and portions adjacent to some of the coupling portions and hinge members of the tile 110. The support grid 128 can be integrally formed with an under-side of the top surface 112 and defines a depth 129 of the tile 110 with the periphery portions 127 of the support grid 128 at least partially defining the opposite first and second lateral sides 120 and 122 and the opposite front and rear sides 116 and 118. At least a portion of the periphery portions 127 and the wave configuration is configured to be positioned against the floor surface to support the tile 110.

Figure 5A:
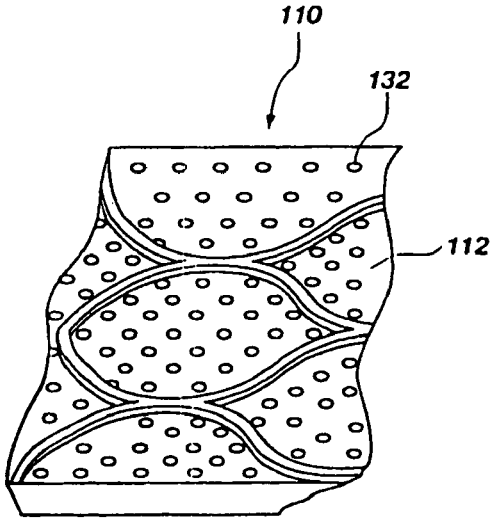
FIG. 5 illustrates a partial perspective view of a top surface of the tile, depicting the tile having a raised portion defined on the top surface thereof.
Figure 5:
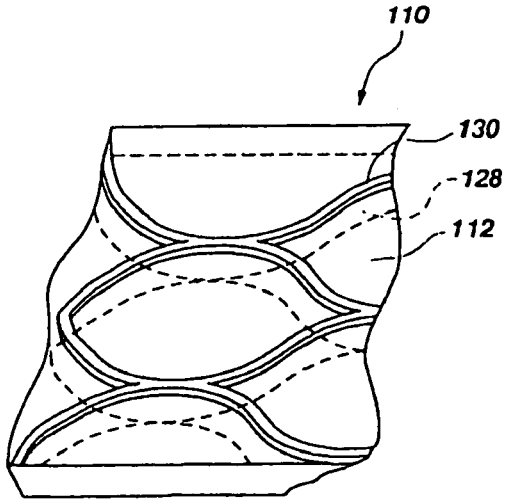

With respect to FIG. 5, the top surface 112 of the tile 110 can be a substantially planar surface and can include a raised portion 130 formed integrally with the top surface 112 and configured to provide a gripping surface to the tile 110. Such a raised portion 130 can be configured to substantially mimic the wave configuration of the support grid 128 to hide an otherwise visible impression of the support grid 128 formed below the top surface 112. The raised portion 130 also can improve the aesthetic appearance of the tile 110 by hiding the impression of the support grid 128.

As depicted in FIG. 5(*a*), in another embodiment, the top surface 112 can include perforations 132 formed through the top surface 112. Such perforations 132 are sized and configured to allow liquid to pass therethrough. The perforations 132 can prevent, for example, the pooling of water on the tiles 110. This can be advantageous in cases where the tiles 110 are placed temporarily onto, for example, a grass surface, so that the perforations 132 can facilitate breathability, while allowing water to drain through to the grass disposed below the tiles.

Figure 6:
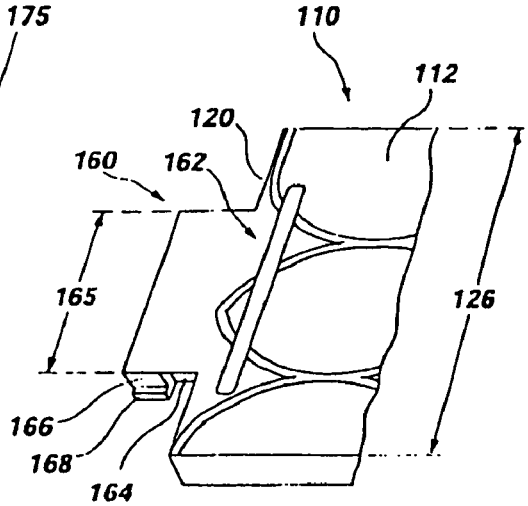
FIG. 6 illustrates a partial perspective view of the tile, depicting a first coupling portion formed in one of the lateral sides of the tile.

With respect to FIG. 6, the first coupling portion 160 of the first lateral side 120 of the tile 110 can be a tab configuration or male coupling portion. Such a first coupling portion 160 can include a first extension 164 configured to extend from a first end portion 162 of the tile 110. The first extension 164 can include an upper surface that can extend substantially flush with the top surface 112 of the tile 110. The first extension 164 can include a second extension 166 configured to extend laterally downward from the first extension 164 to define a channel portion 169 between the second extension 166 and the first lateral side 120. The second extension 166 can include nubs 168 integrally formed with and extending from opposite ends of the second extension 166. Such nubs 168 can be configured to provide an interference and/or locking fit with the complementary second coupling portion 170 (FIG. 7) of another tile 110. The first coupling portion 160 can include a coupling length 165, including at least one of the first and second extensions 164 and 166, that can be at least one-third the width 126 of the tile 110, and preferably, at least ½ the width 126 of the tile 110. That is, the first coupling portion includes structure having the coupling length 165 that extends continuously along the first lateral side of the tile.

Figure 7:
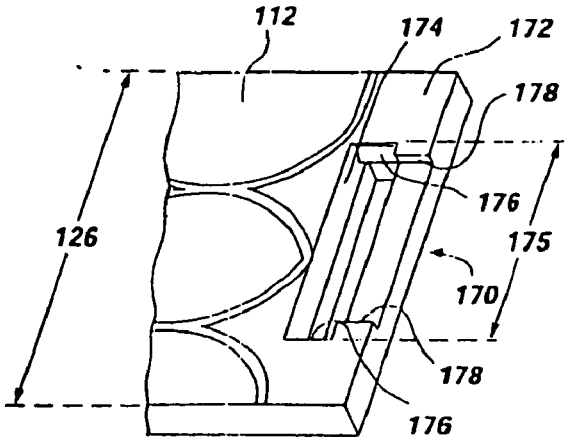
FIG. 7 illustrates a partial perspective view of the tile, depicting a second coupling portion formed in one of the lateral sides of the tile.

With respect to FIG. 7, the second coupling portion 170 of the second lateral side 122 of the tile 110 can be a slot configuration or female coupling portion. Such a second coupling portion 170 can include an elongate opening 174 defined through a second end portion 172 of the tile 110 and between the top surface 112 and the bottom side 114 (FIG. 3) of the tile 110. The elongate opening 174 can include an opening length 175 extending continuously at least one-third the width 126 of the tile 110, and preferably, at least ½ the width 126 of the tile 110. Such an elongate opening 174 is sized and configured to at least partially receive the first coupling portion 160 (FIG. 6). The elongate opening 174 can be defined with a ledge portion 176 at opposing longitudinal ends of the elongate opening 174. In addition, the second coupling portion 170 can include an elongate recessed portion 178 defined in the second end portion 172 of the top surface 112 of the tile 110 and between the second lateral side 122 and the elongate opening 174. The elongate recessed portion 178 can extend, but is not limited to, substantially a similar length as the elongate opening 174.

Figure 8:
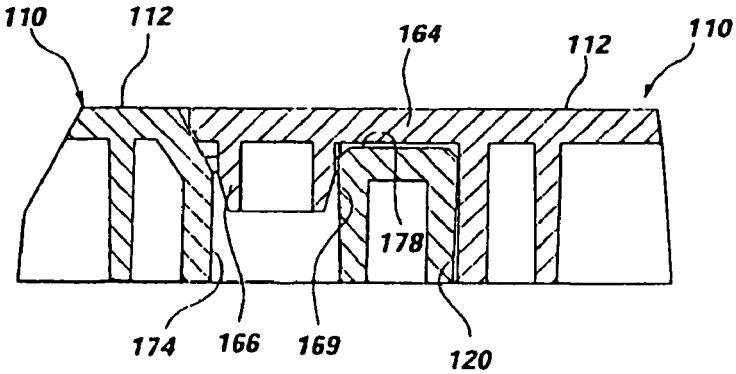
FIG. 8 illustrates a cross-sectional view of two adjacently coupled tiles taken along line 8 in FIG. 1, depicting the first and second coupling portions in a coupled arrangement.
Figure 8A:
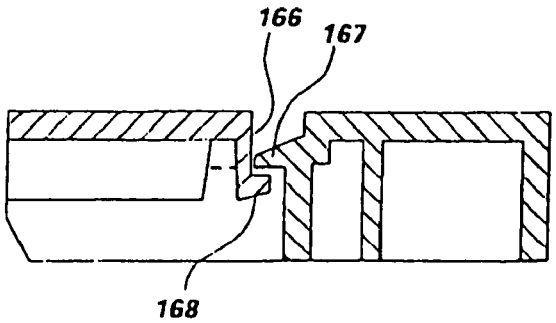

With respect to FIGS. 6, 7, 8 and 8(*a*), the first coupling portion 160 of one tile 110 is configured to couple with the second coupling portion 170 of another tile 110. In particular, the second extension 166 is sized and configured to sit within the elongate opening 174 with the nubs 168 tightly sliding over and beyond the ledge portion 176 in the elongate opening 174 in a removable snap-in arrangement. The nubs 168 and/or ledge portion 176 can be flexible to allow the nubs 168 to slide over the ledge portion 176 and provide secure engagement. Further, the channel portion 169 is configured to receive the second end portion 172 defining the elongate recessed portion 178 so that the top surface 112 for each tile 110 is flush with each other. With this arrangement, the first coupling portion 160 is configured to couple with the second coupling portion 170 in a nesting rigid manner having a tight tolerance with substantially no transverse and longitudinal movement between the two coupled tiles 110.

As can be well appreciated by one of ordinary skill in the art, the first and second coupling portions 160 and 170 can include other suitable configurations that employ a similar function. In one embodiment, the first and second coupling portions 160 and 170 can include the respective coupling length 165 and opening length 175 of at least one-third the width of the tile. In another embodiment, one of the first and second coupling portions 160 and 170 can include a length of at least one-third the width of the tile, while the other of the first and second coupling portions can be configured with one or more couplings with a smaller length or lengths. As such, other suitable configurations that provide a length of at least one-third the width of the tile can be employed that allow the installer to readily identify the placement for attachment of the tiles to thereby, improve the efficiency of installation. With this arrangement, the sizing of the coupling length 165 and opening length 175 being at least one-third the width of the tile 110 enhances the efficiency of the installer in aligning and coupling the tiles together since such aligning and coupling of the tiles is readily identifiable. Further, such sizing minimizes the number of couplings necessary to sufficiently couple the tiles together to further provide greater speed and accuracy during the installation process.

Figure 9:
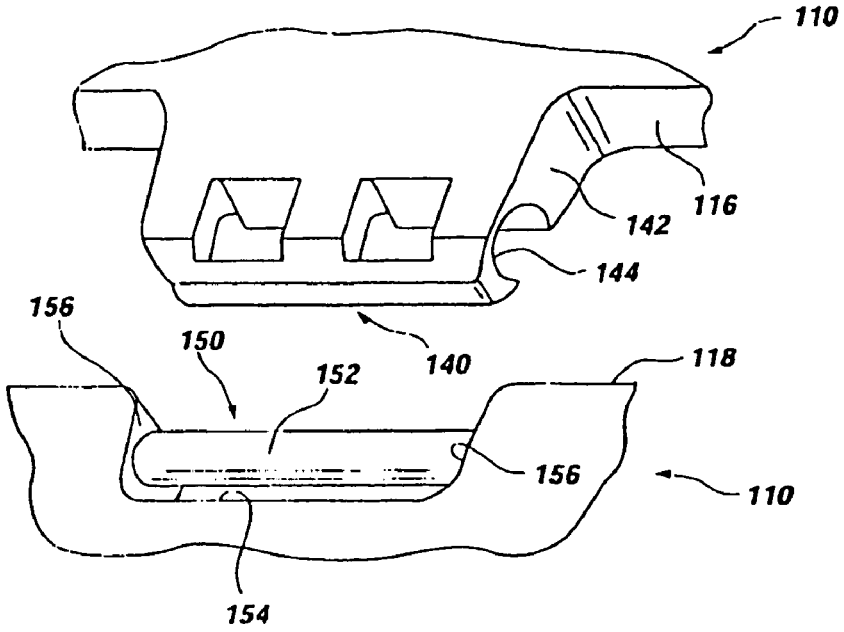
FIG. 9 illustrates a partial perspective view of two adjacently positioned tiles, depicting complementary hinge couplings uncoupled and facing each other.

Turning now to FIG. 9, the first hinge member 140 of the front side 116 is configured to couple with the second hinge member 150 disposed on the rear side 118 of another tile 110. The front and rear sides 116 and 118 of the tile 110 can include one or more respective first and second hinge members 140 and 150, and preferably three respective first and second hinge members. The first hinge member 140 can include a hinge configuration protruding outward from the front side 116 of the tile 110 with a post attaching portion 142 defining a post channel 144 therein. The post attaching portion 142 is configured to receive a post portion 152 defined in the second hinge member 150. Also, the post attaching portion 142 can include one or more through holes, recesses or the like, to limit the material and provide flexibility in the post attaching portion 142.

The rear side 118 of the tile 110 can include one or more second hinge members 150, each corresponding with one of the first hinge members 140. Each of the second hinge members 150 can define a notch 154 in the rear side 118 of the tile, which can extend between the top surface 112 and the bottom side 114 (FIG. 3) of the tile 110. Further, each notch 154 can include the post portion 152 extending longitudinally and integrally formed between opposing sides 156 of the notch 154. The post portion 152 is sized and configured to be positioned and disposed within the post channel 144 defined in the post attaching portion 142 of the first hinge member 140.

Figure 10:
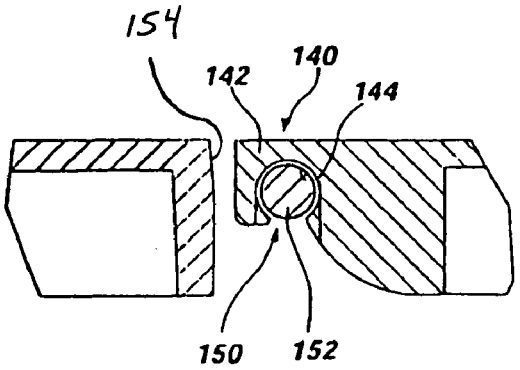
FIG. 10 illustrates a cross-sectional view of two adjacently coupled tiles taken along line 10 in FIG. 1, depicting the complementary hinge couplings in a coupled arrangement.
Figure 10A:
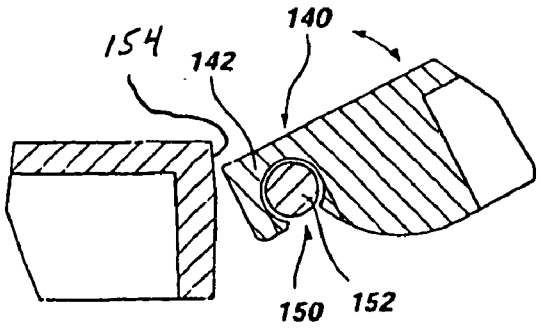

With respect to FIGS. 10, 10(*a*) and 12, the first and second hinge members 140 and 150 of two adjacent tiles may be coupled together and configured to rotate with respect to each other. Also, the post attaching portion 142 defining the post channel 144 of the first hinge member 140 is open-ended to facilitate the first and second hinge members 140 and 150 to readily be attached to and removable from each other. As depicted, the post attaching portion 142 is sized and configured to receive the post portion 152 contained within the notch 154 of the second hinge member 150 with a snap-in and rotatable type fit. Further, the first hinge member 140 can readily rotate about the post portion 152 of the second hinge member 150, with the coupling arrangement configured to allow the post attaching portion 142 to clear the notch 154 during rotation. Such rotation facilitates rolling and unrolling one or more columns of the tiles 110 into a tile role 180.

Figure 11:
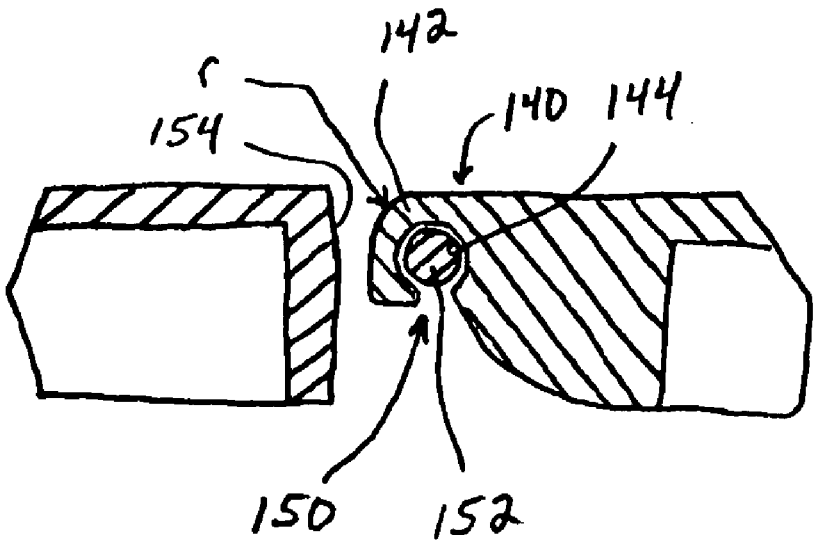
FIG. 11 illustrates a cross-sectional view of two adjacently coupled tiles taken along line 10 in FIG. 1, depicting the complementary hinge couplings in a coupled arrangement and the radius formed about the corner of the post attaching portion.
Figure 11A:
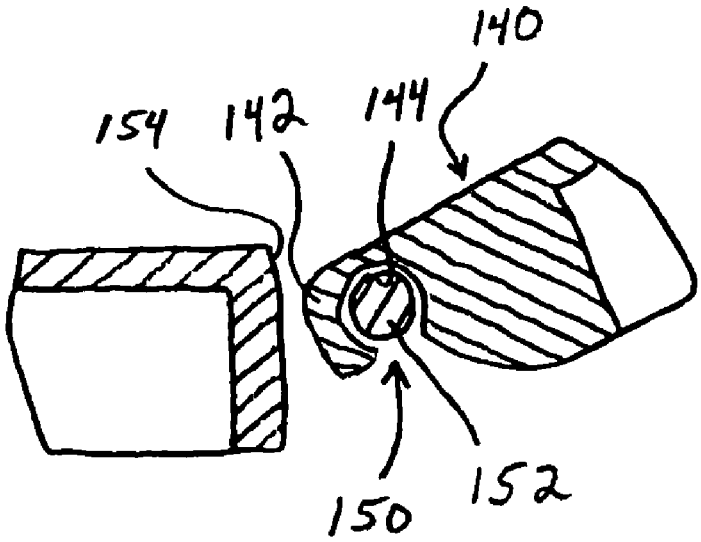

With respect to FIGS. 9, 11, and 11(*a*), the first and second hinge members 140 and 150 of two adjacent tiles may be coupled together and configured to rotate with respect to each other in a similar manner as discussed above. The post attaching portion 142 of the first hinge member 140 is open-ended to facilitate the first and second hinge members 140 and 150 to readily be attached to and removable from each other. In addition, in the embodiment shown herein, the post attaching portion 142 defining the post channel 144 may further comprise a radius r formed about the corner of its outermost edge portions, or at their intersection. The radius r formed on the corner of the post attaching portion 142 facilitates a closer fit or tolerance to be achieved between the two mating tiles. Indeed, by rounding the corner of the post attaching portion 142, the post portion 152 extending longitudinally and integrally formed between opposing sides 156 of the notch 154 may be positioned closer to the notch than with the configuration shown in FIG. 9. This is made possible because less distance is needed between the notch and the edge of post attaching portion 142 as the two adjacent tiles, and more particularly the first and second hinge members 140 and 150, are rotated about one another. The rounded corner allows the post attaching portion 142 to still clear the edge of the notch 154. As a result, the two adjacent tiles and their respective surfaces may be coupled together in a much closer coupling arrangement, which in effect, reduces the crack size between the adjacent tiles.

Figure 13:
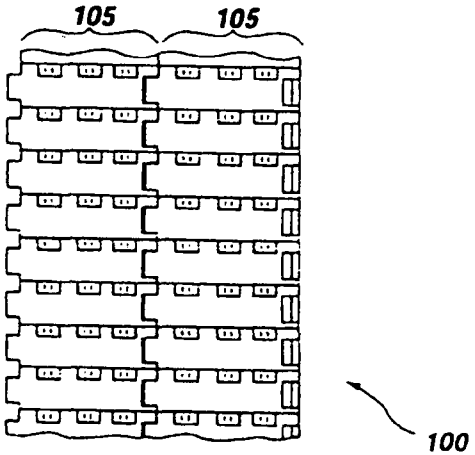
FIG. 13 illustrates a top view of two columns of tiles, depicting the two columns with the first and second coupling portions aligned to be coupled together to form a tile array.
Figure 13A:
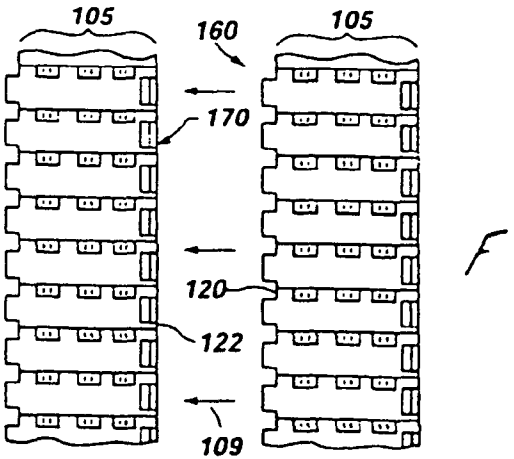
Figure 12:
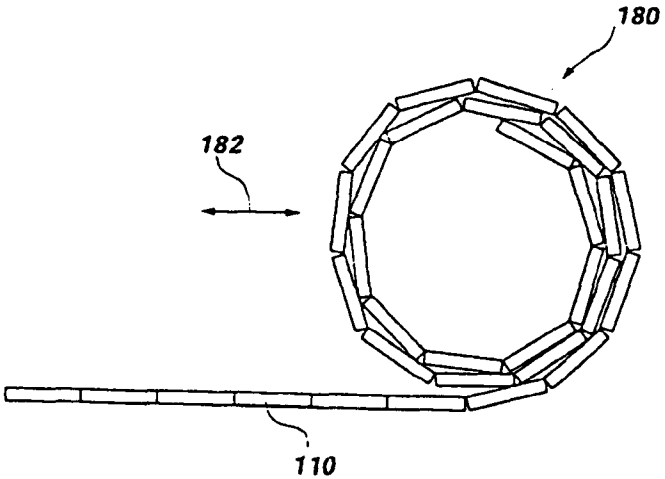
FIG. 12 illustrates a side view of the tiles in a tile role, depicting the tiles coupled to each other at the hinge coupling in the tile roll and unrollable during installation of the tiles.

With respect to FIGS. 6, 7, 9, 12, 13 and 13(*a*), multiple tiles can be interconnected at the first and second hinge members 140 and 150 to form the columns 105 of tiles 110 which can be rolled-into and rolled-out from a tile roll 180, as indicated by arrow 182. Once two or more tile rolls 180 are rolled-out to form two or more columns 105, the first and second coupling portions 160 and 170 of the respective first and second lateral sides 120 and 122 of the tiles 110 can be coupled together, as indicated by arrows 109, to form the tile array 100, as depicted in FIG. 13(*a*). As can be well appreciated by one of ordinary skill in the art, the rigid coupling between the first and second coupling portions 160 and 170 having a coupling length 165 at least one-third the width 126 of each tile 110 maintains a secure coupling between columns 105 of tiles 110 so that each tile 110 is fitted into position without transverse displacement or movement. Furthermore, the placement and positioning of the first and second coupling portions 160 and 170 is readily identifiable by an installer, making for ready alignment and attachment of the first and second coupling portions 160 and 170 to form the tile array 100 quickly and efficiently. In addition, the first and second coupling portions 160 and 170 can be readily disengaged between adjacent columns 105. One or more columns can then be rolled-into the tile role 180 for ready storage of the tiles 110.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. A tile configured to form a modular floor covering including an array of substantially identical tiles, the tile comprising:

a top surface having an elongated shape and a bottom side including a support grid;

front and rear sides defined along a longitudinal length of the elongated shape, the front side including at least one first hinge member and the rear side including at least one complementary second hinge member configured to be engageable with an at least one first hinge member of an adjacently positioned tile; and first and second lateral sides defining a width of the elongated shape, the first and second lateral sides including a respective tab and slot coupling portion wherein a length of the at least one first hinge member is different than a length of the tab.

2. The tile of claim 1, wherein the tab and slot coupling portion are each configured to removably couple with the respective slot and tab coupling portions of other tiles positioned adjacent the first and second lateral sides, respectively.

3. The tile of claim 2, wherein the tab coupling portion comprises an upper surface substantially flush with the top surface of the tile.

4. The tile of claim 3, wherein the tab coupling portion comprises a downward tab extension configured to rigidly nest in a slot coupling portion of an adjacently positioned tile.

5. The tile of claim 1, wherein the support grid comprises a wave configuration configured to stabilize the top surface of the tile.

6. The tile of claim 1, wherein the top surface comprises a raised portion operable to substantially mimic a configuration of the support grid to conceal an impression of the support grid and provide a gripable surface to the top surface.

7. The tile of claim 1, wherein the top surface comprises perforations defined therethrough to extend to the bottom side configured to allow liquid to pass through the perforations.

8. The tile of claim 1, wherein the at least one first and second hinge members formed on the respective front and rear sides are each configured to mate with respective complementary second and first hinge members of another tile positioned adjacent the front and rear sides, respectively.

9. The tile of claim 8, wherein the at least one first and second hinge members are configured to rotate with the respective complementary second and first hinge members of the other tiles positioned adjacent the front and rear sides, respectively.

10. The tile of claim 1, wherein the first hinge member comprises a hinge configuration protruding outward from the front side of the tile, wherein the hinge configuration comprises a post attaching portion defining a post channel therein.

11. The tile of claim 10, wherein the post attaching portion comprises a rounded corner on at least a portion of its outermost edge to facilitate clearance between the first and second hinge members during rotation, and to provide a closer fit between adjacent coupled tiles.

12. A modular floor covering, comprising:

multiple tiles configured to be removably coupled to form a tile array including columns and rows of the multiple tiles, at least one of the multiple tiles including:

a top surface having an elongated shape and a bottom side including a support grid;

front and rear sides defined along a longitudinal length of the elongated shape, the front side including at least one first hinge member and the rear side including at least one second hinge member; and first and second lateral sides defining a width of the elongated shape, the first and second lateral sides including a respective tab and slot coupling portion wherein a length of the at least one first hinge member is different than a length of the tab;

wherein the at least one first and second hinge members formed on the respective front and rear sides are each configured to mate with respective complementary second and first hinge members of other tiles positioned adjacent the front and rear sides, respectively; and wherein the tab and slot coupling portion of the respective first and second lateral sides are each configured to rigidly mate with respective slot and tab coupling portions of the tiles positioned adjacent the first and second lateral sides, respectively.

13. The modular floor covering of claim 12, wherein the tab and slot coupling portions are configured to substantially prevent transverse movement between adjacent columns of the multiple tiles.

14. The modular floor covering of claim 12, wherein the top surface comprises a raised portion operable to at least partially and substantially mimic a configuration of the support grid to conceal an impression of the support grid and provide a gripable surface to the top surface of the tile array.

15. The modular floor covering of claim 12, wherein the support grid of each of the tiles comprises a wave configuration operable to stabilize the top surface of each of the tiles.

16. The modular floor covering of claim 12, wherein the top surface comprises perforations defined therethrough to extend to the bottom side and configured to allow liquid to pass through the perforations.

17. The modular floor covering of claim 12, wherein the at least one first and second hinge members are configured to rotate with respective complementary second and first hinge members of other tiles to form a column of tiles operable to be rolled-into and rolled-out from a tile roll.

18. The tile of claim 12, wherein the first hinge member comprises a hinge configuration protruding outward from the front side of the tile, wherein the hinge configuration comprises a post attaching portion defining a post channel therein.

19. The tile of claim 18, wherein the post attaching portion comprises a rounded corner on at least a portion of its outermost edge to facilitate clearance between the first and second hinge members during rotation, and to provide a closer fit between adjacent coupled tiles.

20. A method of installing a modular flooring onto a floor surface, the method comprising:

unrolling multiple tile rolls, each having at least one column of tiles, onto a floor surface with a top surface facing upward and a bottom side having a support grid facing the floor surface, the tiles coupled together along a longitudinal length of front and rear sides of the tiles with at least one combination of first and second hinge members integrally formed in the respective front and rear sides of the tiles; and coupling adjacently positioned columns by interconnecting a tab and slot coupling portion formed in respective first and second lateral sides of each of the tiles to form a tile array of the tiles, wherein a length of the at least one first hinge member is different than a length of the tab.

21. The method of claim 20, wherein the coupling comprises nesting the first coupling portion with a downward extension disposed in a coupling opening with a removable rigid fit.

22. A tile configured to form a modular floor covering including an array of substantially identical tiles, the tile comprising:

a top surface having a periphery and an under-side including a support configuration;

at least two opposing sides of the periphery each including a coupling portion, wherein a first side of the periphery comprises a protruding coupling portion, wherein an opposing second side of the periphery comprises a receiving coupling portion, first and second hinge members disposed about the periphery of the tile, wherein the length of the first hinge member is different than a length of the protruding coupling portion.

23. A modular floor covering, comprising:

multiple tiles configured to be removably coupled to form a tile array, each of the multiple tiles including:

a top surface having a periphery and an under-side including a support configuration;

at least two opposing sides of the periphery each including a coupling portion, wherein a first side of the periphery comprises a protruding coupling portion, and wherein an opposing second side of the periphery comprises a receiving coupling portion, wherein the coupling portions of the at least two opposing sides are configured to couple with complementary coupling portions formed with adjacently positioned tiles; and at least one hinge member disposed about the periphery of the tile and a second hinge member disposed opposite the first hinge member, wherein a length of the at least one hinge member is different than a length of the protruding coupling portion.

24. A modular floor covering, comprising:

multiple tiles configured to be removably coupled to form a tile array, each of the multiple tiles including:

a top surface having a periphery and an under-side including a support configuration;

at least one side of the periphery defining a length and including a first coupling portion, the first coupling portion having a coupling length at least one-third the length of the at least one side, a second coupling portion disposed opposite the first coupling portion; and first and second hinge members disposed about the periphery, wherein a length of the first hinge member is different than a length of the first coupling portion.

* * * * *